US008235262B1

(12) United States Patent
Sakdol

(10) Patent No.: US 8,235,262 B1
(45) Date of Patent: Aug. 7, 2012

(54) MAGNETIC IMPLEMENT HOLDER

(76) Inventor: Corbin Sakdol, Littleton, CO (US)

( * ) Notice: Subject to any disclaimer, the term of this patent is extended or adjusted under 35 U.S.C. 154(b) by 259 days.

(21) Appl. No.: 12/779,624

(22) Filed: May 13, 2010

(51) Int. Cl.
*A45F 5/00* (2006.01)
*A45F 5/02* (2006.01)
*B43K 25/00* (2006.01)

(52) U.S. Cl. ..... 224/183; 224/250; 224/251; 24/10 R; 24/11 CT

(58) Field of Classification Search ..... 224/181, 224/183, 247, 250, 251, 562, 609, 621, 918, 224/931; 24/303, 10 R, 11 CC, 11 CT, 11 F, 24/11 FE, 11 HC, 11 PP, 11 R, 11 S; 248/206.5, 248/214, 223.41, 224.8, 225.11, 228.1, 228.5, 248/309.4, 346.03, 683
See application file for complete search history.

(56) References Cited

U.S. PATENT DOCUMENTS

| | | | | |
|---|---|---|---|---|
| 1,401,809 | A * | 12/1921 | Morin | 24/11 CT |
| 2,297,806 | A * | 10/1942 | Smith | 211/69.1 |
| 2,594,955 | A * | 4/1952 | Markowitz | 248/683 |
| 2,644,212 | A * | 7/1953 | Markowitz | 24/11 R |
| 3,159,372 | A * | 12/1964 | McIntosh | 248/683 |
| 3,178,784 | A * | 4/1965 | Krauthamer | 24/10 R |
| 3,627,182 | A | 12/1971 | Calkins | |
| D357,278 | S | 4/1995 | Turney | |
| 6,163,889 | A | 12/2000 | Tate | |
| 6,170,088 | B1 | 1/2001 | Tate | |
| 6,367,126 | B1 * | 4/2002 | Rivkin | 24/3.3 |
| 6,530,510 | B2 * | 3/2003 | Ferrari | 224/547 |
| 6,966,851 | B1 | 11/2005 | England | |
| 6,972,022 | B1 | 12/2005 | Griffin | |
| 7,101,103 | B1 | 9/2006 | Dietz | |
| 7,496,991 | B2 * | 3/2009 | Avery | 24/3.3 |
| 7,527,447 | B2 | 5/2009 | Huang | |
| 2002/0034992 | A1 | 3/2002 | Tate | |
| 2003/0145500 | A1 | 8/2003 | Lykens | |
| 2004/0237262 | A1 | 12/2004 | Arnone | |
| 2005/0062730 | A1 * | 3/2005 | Birecki | 345/179 |
| 2005/0223525 | A1 | 10/2005 | Wartian | |
| 2008/0054033 | A1 * | 3/2008 | Synness | 224/181 |
| 2008/0083051 | A1 | 4/2008 | Cunliffe | |
| 2008/0240840 | A1 | 10/2008 | Huang | |
| 2009/0273755 | A1 | 11/2009 | Laventure | |

FOREIGN PATENT DOCUMENTS

| | | | |
|---|---|---|---|
| CA | 2260113 | * | 7/2000 |

* cited by examiner

*Primary Examiner* — Charles A Fox
*Assistant Examiner* — Todd Anderson
(74) *Attorney, Agent, or Firm* — QuickPatents, Inc.; Kevin Prince

(57) ABSTRACT

A holder for securing a writing implement to a worn article is described. The holder includes a magnet fixed with the worn article and a magnetically-attractive base having a lower surface, an upper surface, and a peripheral edge. The upper surface includes two slots therein. The holder also includes a clamp portion having two ends adapted to engage the two slots of the upper surface of the base, and an elastomeric band securing the clamp portion to the slots of the upper surface of the base that retains the writing implement. The writing implement may be inserted between the clamp piece and the base, thereby pushing the ends of the clamp portion away from, but not completely out of, the slots of the upper surface of the base. The base, writing implement, clamp portion, and elastic band are magnetically attachable to the worn article with the magnet.

16 Claims, 3 Drawing Sheets

MAGNETIC IMPLEMENT HOLDER

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to a holder for securing a writing implement, and more particularly to a holder for securing the writing implement to a worn article.

DISCUSSION OF RELATED ART

While performing many tasks, it is desirable to be able to have a writing implement available, such as a pen, marker, chalk piece, or carpenter's pencil. Without a wearable holder of some kind, a user must resort to imperfect solutions, such as setting down the implement), placing the writing implement in a clothes pocket (which increases the risk of damage to the writing implement or injury to the individual), or carrying around a cumbersome tool holder such as a utility belt or a satchel. One solution is to secure the writing implement to the individual's headwear, so the writing implement is secured, readily available and not in a position to be damaged or to injure the individual.

Although devices for securing items to headwear are known, these devices generally are limited for use with only one particular piece of headwear, or are not adapted for use with writing implements. For example, U.S. Pat. No. 6,163,889 to Tate filed on Jun. 18, 1999 ("Tate") describes an article of clothing that includes a permanent magnet secured in position to a concealed layer of fabric, where the magnet exerts a magnetic field that acts on an exposed layer of fabric to hold objects in place, including short golf pencils. However, the device in Tate pencil must be short and must have a "metal portion, such as a thin iron or steel band 182." See Tate, col. 10, 11. 33-37. It is uncommon for many writing implements to have such a metal portion that would be affected by the magnetic field, and would seemingly limit the writing implements usable with the Tate device.

Another example of a known device for securing items to headwear that works only with certain headwear is described in U.S. Patent Application Pub. No. 20050223525 to Wartian et al. filed on Jun. 6, 2005 ("Wartian"). Wartian describes a clip that is seemingly adapted to attach a pencil or the like to a wearer's cap. The clip has a first channel adapted to receive a lower edge portion of a wearer's cap, and a slot adapted to grip a pencil between the sides of the slot. However, because the first channel is seemingly constructed of a semi-rigid material (in order to hold the clip in place), the clip would be seem to be unsuitable for use with a hard hat or similar headwear where the clip would be unable to establish a firm grip (e.g., because the hard hat has a curved surface, and/or may be made of a material that is too thin for the first channel to hold the clip in place). Furthermore, clip relies upon the slot to grip the pencil, which may be disadvantageous because force is needed to engage and disengage the pencil, which can cause the wearer to have difficulty and/or cause the clip to move around the cap. Another disadvantage of relying upon a slot to grip the pencil is that over time, the slot will be exposed to wear and either break or grip the pencil more weakly, thereby risking dropping the pencil. Furthermore, such a device has an undesirable, unsightly plastic clip fixed with the hat.

Other examples of device for securing items to headwear are shown, for example, in U.S. Patent Application Pub. No. 20080083051 to Cunliffe filed on Oct. 6, 2006 ("Cunliffe") and U.S. Pat. No. 6,966,851 to England et al. filed on Feb. 18, 2004 ("England"). However, the securing devices shown in Cunliffe and England are visible even when not securing items, thereby rendering the headwear unsightly when not holding a writing implement.

Therefore, there is a need for a device that secures the writing implement to the individual's headwear, so the writing implement is readily available and not in a position to be damaged or to injure the individual. Such a device would be usable with a variety implements, and would be designed so as not to require substantial force to remove and secure the writing implement in place. The device would also not be visible when not holding the writing implement, and would therefore not substantially alter the appearance of the headwear when not in use. The present invention accomplishes these objectives.

SUMMARY OF THE INVENTION

The present device is a holder for securing a writing implement to a worn article. The holder includes a magnet fixed with the worn article and a magnetically-attractive base having a lower surface, an upper surface, and a peripheral edge. The upper surface includes two slots therein. The holder also includes a clamp portion having two ends adapted to engage the two slots of the upper surface of the base, and an elastomeric band securing the clamp portion to the slots of the upper surface of the base. The writing implement may be inserted between the clamp piece and the base, thereby pushing the ends of the clamp portion away from, but not completely out of, the slots of the upper surface of the base. The elastic band applies pressure to and retains the writing implement between the clamp portion and the base. The base, writing implement, clamp portion, and elastic band are magnetically attachable to the worn article with the magnet, which is preferably hidden within the worn article.

In an exemplary embodiment, the clamp portion may generally be U-shaped in cross-section and the magnet may be fixed to the worn article with adhesive. Also, the ends of the clamp may be notched, such that the length of the clamp portion substantially matches the length of the base, the slots in the base and the ends of the clamp each being shorter than the length of the base and the clamp portion. The slots in the upper surface of the base may extend through the lower surface of the base, or may extend substantially 80% of the way through the base to the lower surface thereof in an exemplary embodiment to provide additional stability.

The claimed holder secures the writing implement to the individual's headwear, so the writing implement is secured, readily available and not in a position to be damaged or to injure the individual. The holder is usable with a variety of headwear, may be used with multiple types of writing implements, and does not require clamping to hold the writing implement in place. The holder also is not visible when the writing implement is not secured. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1A:
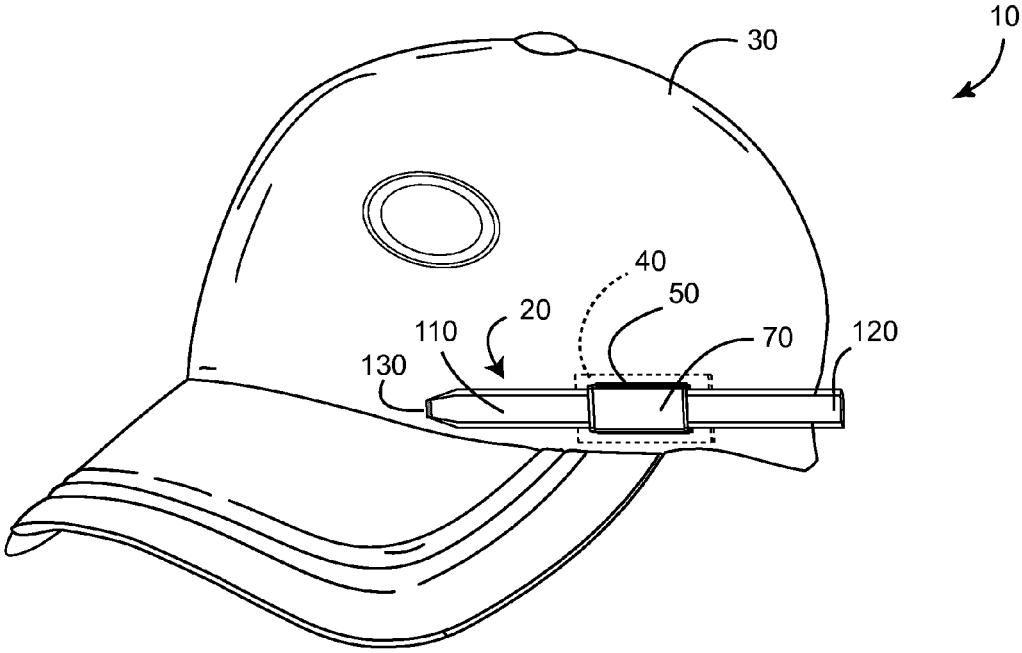
FIGS. 1A and 1B are perspective views of a baseball cap and a hard hat, respectively, each having an exemplary embodiment of a holder for securing a writing implement to a worn article.
Figure 1B:
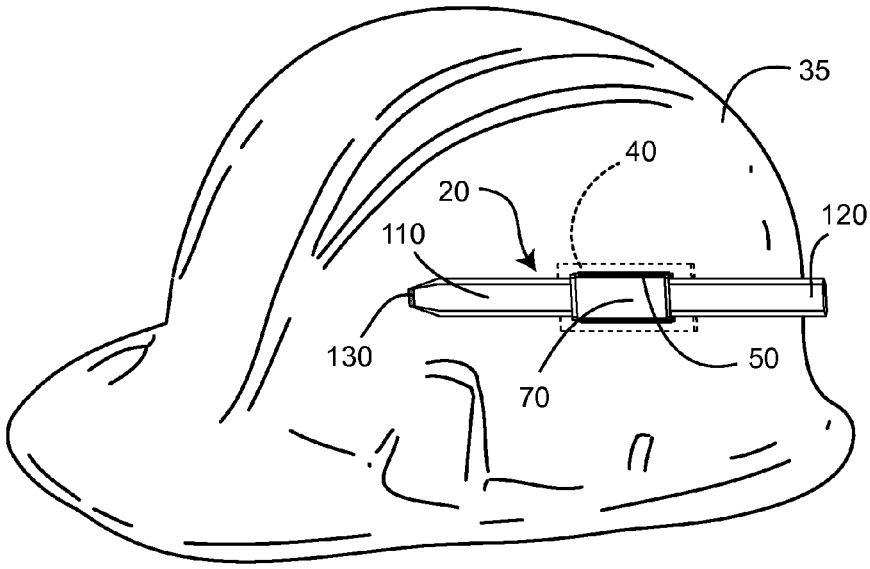

FIGS. 1A and 1B are perspective views of a baseball cap 30 and a hard hat 35, respectively, each having an exemplary embodiment of a holder 10 for securing a writing implement 20 to a worn article. The worn article may be any item that is worn, including any headwear article, or a garment for the upper body such as a shirt or vest. Examples of headwear articles can include a baseball cap 30, hard hat 35, a visor, a headband, etc., as the holder 10 may be used with a variety of different worn articles. The writing implement 20 may be any item used to write, including a pen, marker, chalk, or carpenter's pencil. In an exemplary embodiment, the writing implement 20 has six side edges 110 between a writing end 130 and a top end thereof. The writing implement 20 may be a pencil 120 with a lead writing tip, as is shown in FIGS. 1A and 1B.

The holder 10 includes a magnet 40 fixed inside the worn article, a magnetically-attractive base 50, and a clamp portion 70 (discussed in further detail below). The magnet 40 may be fixed permanently or temporarily with the worn article, for example, using an adhesive that bonds the magnet 40 to the worn article such as glue, or two-sided tape, a fabric hook-and-loop fastener, a pin, etc.

Figure 2:
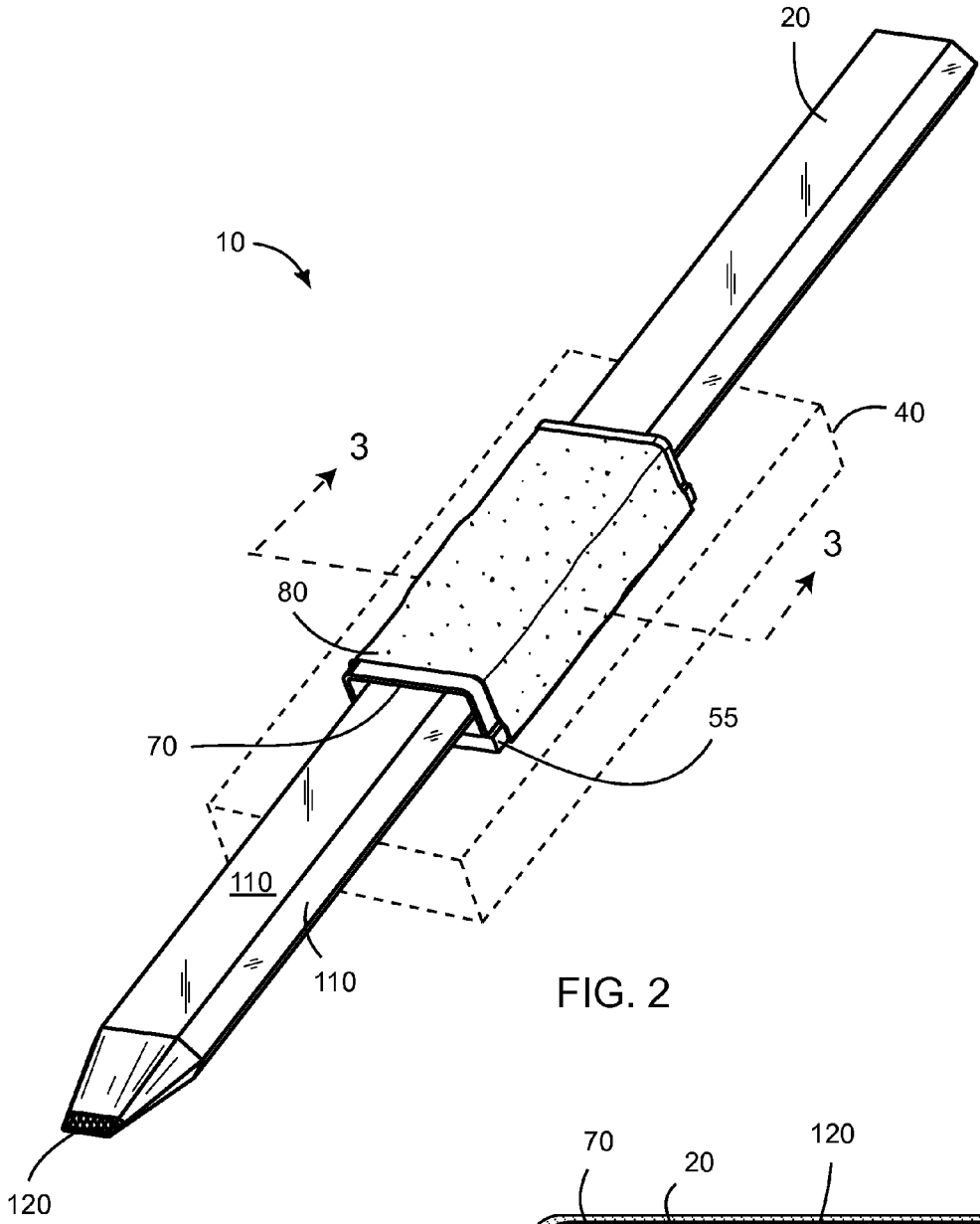
FIG. 2 is a perspective view of an exemplary embodiment of a holder for securing a writing implement to a worn article.
Figure 3:
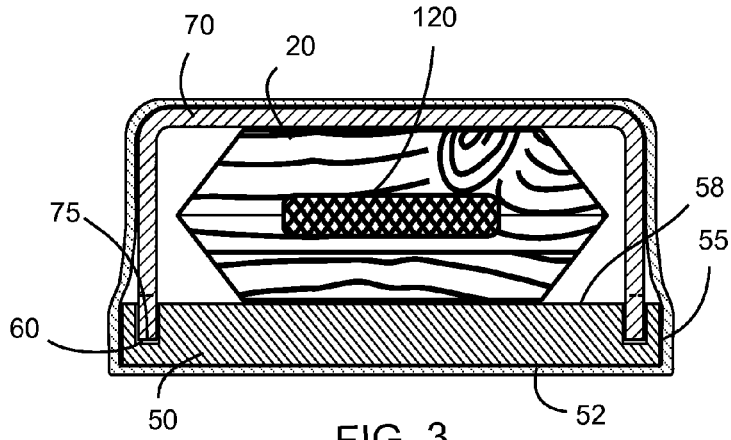
FIG. 3 is a cross-section view of an exemplary embodiment of a holder for securing a writing implement to a worn article.

FIG. 2 is a perspective view of an exemplary embodiment of a holder 10 for securing a writing implement 20 to a worn article. FIG. 3 is a cross-section view of the holder for securing a writing implement to a worn article shown in FIG. 2. The writing implement 20 shown in FIGS. 2 and is a pencil 120 with a lead writing tip, that has six side edges 110 between the writing end and the top end. The holder 10 includes the magnet 40 fixed with the worn article, the magnetically-attractive base 50, and the clamp portion 70.

As shown in FIG. 3, the magnetically-attractive base 50 has a lower surface 52, an upper surface 58, and a peripheral edge 55. The upper surface 58 also includes two slots 60 therein.

The clamp portion 70 has two ends 75 adapted to engage the two slots 60 of the upper surface 58 of the magnetically-attractive base 50. In the exemplary embodiment, the clamp portion 70 is generally U-shaped in cross-section, however any suitable shape may be used for the clamp portion (e.g., ovoid, circular, or V-shaped). The clamp portion 70 itself may be made from a magnetically-attractive material, so that the writing implement 20 may be magnetically fixed with the magnet 40 regardless of orientation.

Figure 6:
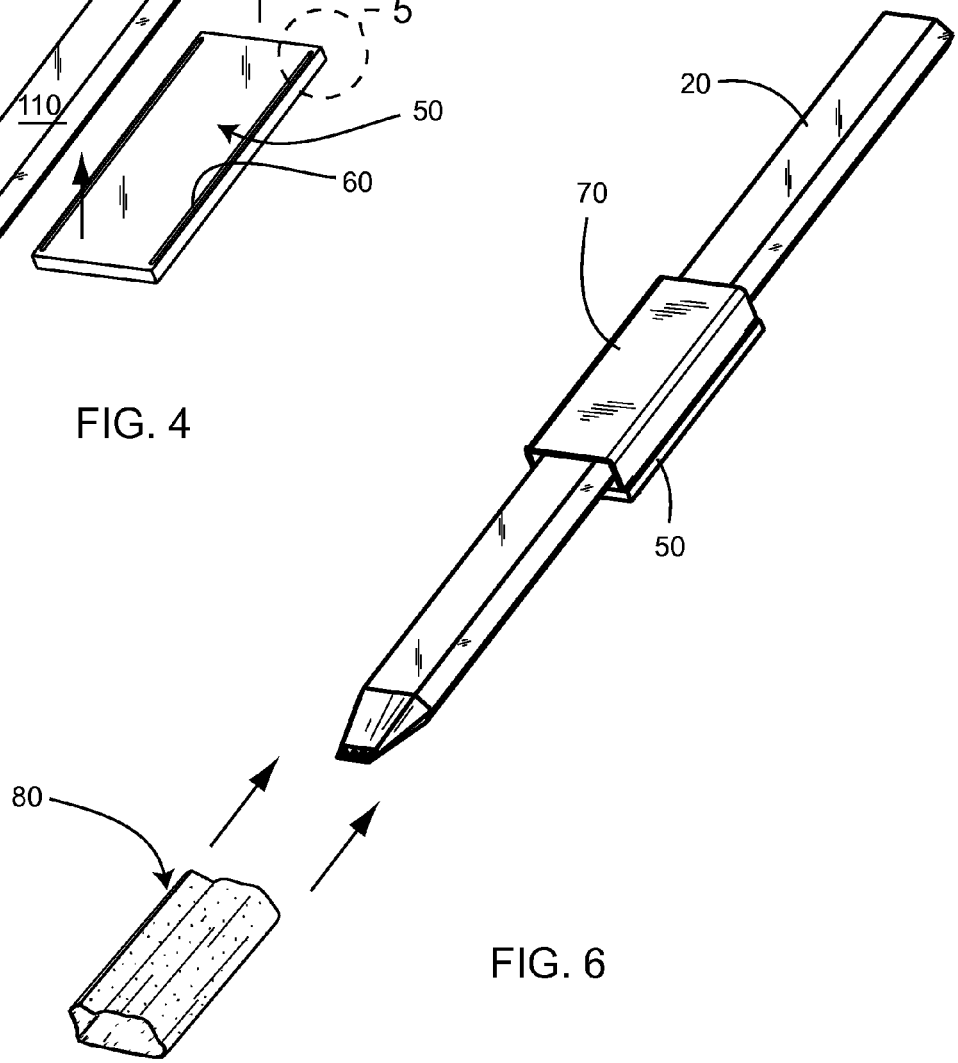
FIG. 6 is a perspective view showing insertion of an exemplary embodiment of a holder for securing a writing implement to a worn article into an elastomeric band.

Finally, an elastomeric band 80 may secure the clamp portion 70 to the slots 60 of the upper surface 58 of the base 50. FIG. 6 is a perspective view showing insertion of an exemplary embodiment of the holder 10 for securing a writing implement to a worn article into the elastomeric band 80. The elastomeric band 80 may advantageously fix the relative positions of the clamp portion 70 and the base 50, thereby applying pressure to reduce the likelihood of the writing implement 20 of falling out of the holder 10.

The writing implement 20 may be inserted between the clamp piece 70 and the base 50, thereby pushing the ends 75 of the clamp portion 70 away from, but not completely out of, the slots 60 of the upper surface 58 of the base 50. The elastic band 80 may retain the writing implement 20 between the clamp portion 70 and the base 50. The base 50, writing implement 20, clamp portion 70, and elastic band 80 are magnetically attachable to the worn article with the magnet 40. The writing implement 20 is thereby allowed to be removed and replaced from the worn article without requiring substantial force needed to remove the writing implement, which may be required in known securing devices.

The holder 10 thereby advantageously secures the writing implement 20 to the worn article, so the writing implement 20 is readily available and not in a position to be modification be made to the exterior of the worn article, and is portable for use with a variety of worn articles. Furthermore, the holder 10 may be used with multiple types of writing implements 20, such as pens, pencils and markers. The holder 10 also is not visible when the writing implement 20 is not secured, as only the magnet 40 remains fixed inside the worn article. When the magnet 40 is not permanently fixed to the worn article, the holder 10 may be moved to different places on the worn article, thereby allowing the position of the holder 10 to be tailored to the wearer's needs based on comfort and utility.

In an exemplary embodiment, the slots 60 in the upper surface 58 of the base 50 extend through the lower surface 52 of the base 50. Such an embodiment may be advantageous for locking the clamp portion 70 in place with respect to the base 50. Also, in another exemplary embodiment, the slots 60 in the upper surface 58 of the base 50 extend substantially 80% of the way through the base 50 to the lower surface 52 thereof. Such an embodiment may similarly keep the clamp portion 70 in place with respect to the base 50.

Figure 4:
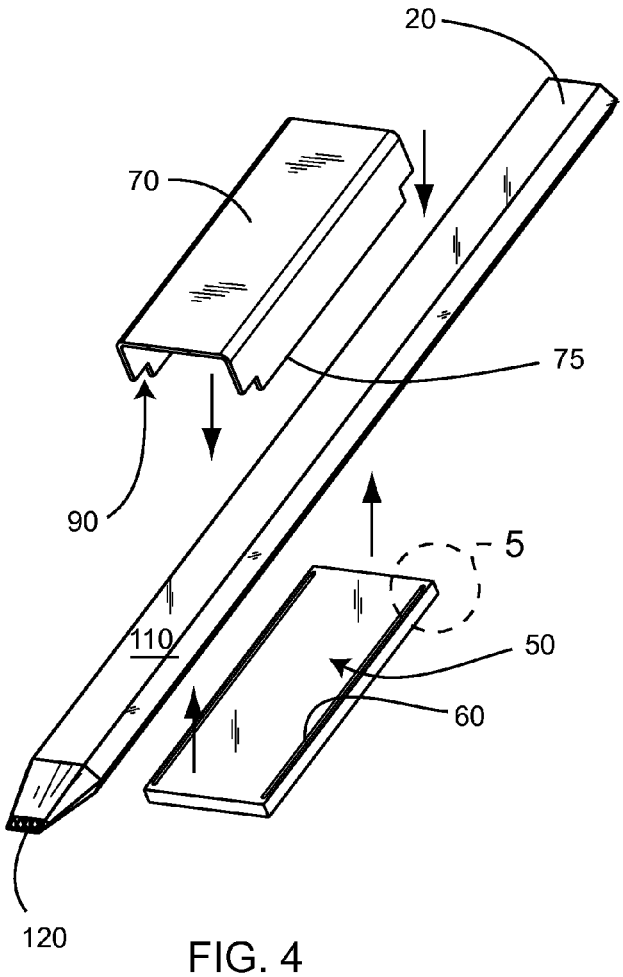
FIG. 4 is an exploded view of an exemplary embodiment of a holder for securing a writing implement to a worn article that includes the writing implement.
Figure 5:
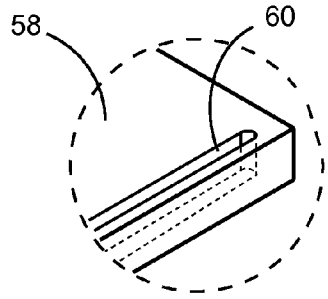
FIG. 5 is an enlarged view of an exemplary embodiment of a holder for securing a writing implement to a worn article showing two slots in an upper surface.

FIG. 4 is an exploded view of an exemplary embodiment of a holder 10 for securing a writing implement 20 to a worn article. The magnetically-attractive base 50, and a clamp portion 70 are shown. As shown in FIG. 4, in an exemplary embodiment the ends 75 of the clamp 70 are notched 90, such that the length of the clamp portion 70 substantially matches the length of the base 50. FIG. 5 is an enlarged view of an exemplary slots in an upper surface. As shown in FIG. 5, the slots 60 in the base 50 and the ends 75 of the clamp portion 70 may each be shorter than the length of the base 50 and the clamp portion 70. Such an embodiment may be advantageous to help prevent the clamp portion 70 from sliding with respect to the base 50, which could cause the writing implement 20 to fall out of the holder 10.

While a particular form of the invention has been illustrated and described, it will be apparent that various modifications can be made without departing from the spirit and scope of the invention. For example, the clamp portion 70 may be circular, to better suit round writing implements such as pens. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A holder for securing a writing implement to a worn article, comprising:

a magnet fixed with the worn article;

a magnetically-attractive base having a lower surface, an upper surface, and a peripheral edge, the upper surface including two slots therein;

a clamp portion having two ends adapted to engage the two slots of the upper surface of the base;

an elastomeric band securing the clamp portion to the slots of the upper surface of the base;

whereby the writing implement may be inserted between the clamp portion and the base, thereby pushing the ends of the clamp portion away from, but not completely out of, the slots of the upper surface of the base, the elastomeric band retaining the writing implement between the clamp portion and the base, the base, writing implement, clamp portion, and elastomeric band magnetically attachable to the worn article with the magnet.

2. The holder of claim 1 wherein the clamp portion is generally U-shaped in cross-section.

3. The holder of claim 1 wherein the ends of the clamp portion are notched, such that the length of the clamp portion substantially matches the length of the base, the slots in the base and the ends of the clamp portion each being shorter than the length of the base and the clamp portion.

4. The holder of claim 1 wherein the slots in the upper surface of the base extend through the lower surface of the base.

5. The holder of claim 1 wherein the slots in the upper surface of the base extend substantially 80% of the way through the base to the lower surface thereof.

6. The holder of claim 1 wherein the magnet is fixed to the worn article with adhesive.

7. The holder of claim 1 wherein the clamp portion is made from a magnetically-attractive material.

8. A holder for a worn article, comprising:

a writing implement;

a magnet fixed with the worn article;

a magnetically-attractive base having a lower surface, an upper surface, and a peripheral edge, the upper surface including two slots therein;

a clamp portion having two ends adapted to engage the two slots of the upper surface of the base;

an elastomeric band securing the clamp portion to the slots of the upper surface of the base;

whereby the writing implement may be inserted between the clamp portion and the base, thereby pushing the ends of the clamp portion away from, but not completely out of, the slots of the upper surface of the base, the elastomeric band retaining the writing implement between the clamp portion and the base, the base, writing implement, clamp portion, and elastomeric band magnetically attachable to the worn article with the magnet.

9. The holder of claim 8 wherein the clamp portion is generally U-shaped in cross-section.

10. The holder of claim 8 wherein the ends of the clamp portion are notched, such that the length of the clamp portion substantially matches the length of the base, the slots in the base and the ends of the clamp each being shorter than the length of the base and the clamp portion.

11. The holder of claim 8 wherein the slots in the upper surface of the base extend through the lower surface of the base.

12. The holder of claim 8 wherein the slots in the upper surface of the base extend substantially 80% of the way through the base to the lower surface thereof.

13. The holder of claim 8 wherein the magnet is fixed to the worn article with adhesive.

14. The holder of claim 8 wherein the clamp portion is made from a magnetically-attractive material.

15. The holder of claim 8 wherein the writing implement has six side edges between a writing end and a top end thereof.

16. The holder of claim 15 wherein the writing implement is a pencil with a lead writing tip.

* * * * *